US010339879B2

(12) United States Patent
Iijima et al.

(10) Patent No.: US 10,339,879 B2
(45) Date of Patent: Jul. 2, 2019

(54) IMAGE PROCESSING APPARATUS, DISPLAY APPARATUS, AND IMAGE PROCESSING METHOD

(71) Applicant: SEIKO EPSON CORPORATION, Tokyo (JP)

(72) Inventors: Chiyoaki Iijima, Ina (JP); Kenichi Tajiri, Matsumoto (JP); Toshiaki Tokumura, Suwa (JP); Yusuke Ogasawara, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 104 days.

(21) Appl. No.: 15/474,228

(22) Filed: Mar. 30, 2017

(65) Prior Publication Data

US 2017/0294168 A1 Oct. 12, 2017

(30) Foreign Application Priority Data

Apr. 12, 2016 (JP) ..... 2016-079494

(51) Int. Cl.
*G09G 3/36* (2006.01)
*G09G 3/00* (2006.01)

(52) U.S. Cl.
CPC ..... *G09G 3/3607* (2013.01); *G09G 3/001* (2013.01); *G09G 3/3611* (2013.01); *G09G 2300/0413* (2013.01); *G09G 2320/029* (2013.01); *G09G 2320/0233* (2013.01); *G09G 2320/0242* (2013.01); *G09G 2320/0271* (2013.01); *G09G 2370/08* (2013.01)

(58) Field of Classification Search
CPC ..... G09G 3/3607; G09G 3/007; G09G 3/18; G09G 5/20; G09G 5/40; G06T 7/30; G06T 15/80; G06T 15/503
See application file for complete search history.

(56) References Cited

U.S. PATENT DOCUMENTS

2002/0063784 A1* 5/2002 Kitagawa ..... G09G 5/00 348/254
2008/0089608 A1* 4/2008 Phillips ..... G06T 15/503 382/283

FOREIGN PATENT DOCUMENTS

JP 2009-031442 A 2/2009
JP 2014-160155 A 9/2014

* cited by examiner

*Primary Examiner* — Alexander Eisen
*Assistant Examiner* — Cory A Almeida
(74) *Attorney, Agent, or Firm* — Oliff PLC

(57) ABSTRACT

An image processing apparatus includes a corrector and a determinator. The corrector corrects a correspondence between display pixels of a display unit and data pixels on an image signal to be inputted to the display pixels so that at least one of the display pixels is defined as a mask pixel to which the image signal is no longer inputted. The determinator determines a gradation of the mask pixel in accordance with a gradation indicated by the image signal to be inputted to an edge pixel that is included in the display pixels and located at an edge of the display pixels.

7 Claims, 9 Drawing Sheets

| | | | | | | | | | | | | | | | | |
|---|---|---|---|---|---|---|---|---|---|---|---|---|---|---|---|---|
| Hsync | | | | | | | | | | | | | | | | |
| DE | | | | | | | | | | | | | | | | |
| Data_IN | 0 | 0 | 0 | 0 | 0 | A | B | C | D | 0 | 0 | 0 | 0 | 0 | 0 | 0 |
| Data_A | X | X | 0 | 0 | 0 | 0 | kA | kB | kC | kD | kD | kD | kD | kD | 0 | 0 | 0 |
| Data_B | X | X | X | 0 | 0 | 0 | 0 | kA | kB | kC | kD | kD | kD | kD | 0 | 0 | 0 |
| DE (2CLK) | | | | | | | | | | | | | | | | |
| Data (2CLK) | X | X | 0 | 0 | 0 | 0 | 0 | A | B | C | D | 0 | 0 | 0 | 0 | 0 | 0 |
| Data_C | X | X | 0 | 0 | 0 | 0 | kA | A | B | C | D | kD | kD | kD | 0 | 0 | 0 |
| Data_Cp | X | X | 0 | 0 | 0 | 0 | kA | kA | kB | kC | kD | kD | kD | kD | 0 | 0 | 0 |
| DE (3CLK) | | | | | | | | | | | | | | | | |
| Data (3CLK) | X | X | X | 0 | 0 | 0 | 0 | 0 | A | B | C | D | 0 | 0 | 0 | 0 | 0 |
| Data_D | X | X | 0 | 0 | 0 | 0 | kA | kA | A | B | C | D | kD | kD | 0 | 0 | 0 |

FIG. 20
| | | | | | | | | |
|---|---|---|---|---|---|---|---|---|
| IMAGE PIXEL VOLTAGE (V) | Vi | 5 | 5 | 5 | 5 | 5 | 5 | 5 |
| COEFFICIENT | k | 0.6 | 0.5 | 0.4 | 0.3 | 0.2 | 0.1 | 0 |
| MASK PIXEL VOLTAGE (V) | Vm | 3 | 2.5 | 2 | 1.5 | 1 | 0.5 | 0 |
| CORNER SPOT (AFTER 200 HOURS) | | INVISIBLE | INVISIBLE | INVISIBLE | INVISIBLE | INVISIBLE | LIGHTLY VISIBLE | VISIBLE |
FIG. 21
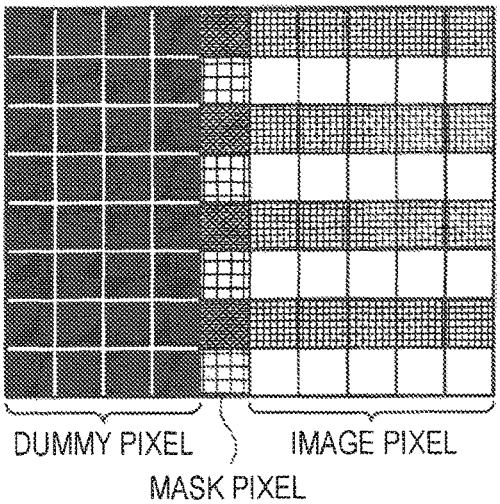
FIG. 22
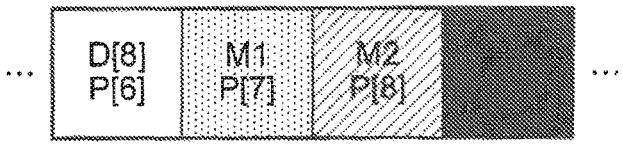
$M1=k1 \cdot D[8]$
$M2=k2 \cdot D[8]$

IMAGE PROCESSING APPARATUS, DISPLAY APPARATUS, AND IMAGE PROCESSING METHOD

BACKGROUND

1. Technical Field

The present invention relates to a technique for correcting display pixel misalignment.

2. Related Art

Display apparatuses including projectors occasionally encounter pixel misalignment in which display pixels are misaligned. Pixel misalignment may cause display defects. For example, when pixels of a specific color component are misaligned, color misalignment occurs accordingly, causing an incorrect color display. JP-A-2014-160155 discloses a technique, called a pixel misalignment correction process, for correcting pixel misalignment. The pixel misalignment correction process shifts the correspondence between pixels of a display apparatus and data pixels indicated by an image signal.

The pixel misalignment correction process may cause a corner spot which is uneven display occurring at the corners of a display region.

SUMMARY

An advantage of some aspects of the invention is that a technique that corrects pixel misalignment while reducing the occurrence of a corner spot is provided.

An aspect of the invention provides an image processing apparatus including a corrector and a determinator. The corrector corrects a correspondence between display pixels of a display unit and data pixels on an image signal to be inputted to the display pixels so that at least one of the display pixels is defined as a mask pixel to which the image signal is no longer inputted. The determinator determines a gradation of the mask pixel in accordance with a gradation indicated by the image signal to be inputted to an edge pixel that is included in the display pixels and located at an edge of the display pixels. According to this aspect, the image processing apparatus corrects pixel misalignment while reducing the occurrence of a corner spot.

The determinator may preferably determine the gradation of the mask pixel by multiplying the gradation of the edge pixel by a coefficient k, where k is a positive real number less than 1. This allows the gradation of the mask pixel to be lower than the gradation of the edge pixel.

The mask pixel may include a first mask pixel and a second mask pixel. The first mask pixel is located closer to the edge pixel than the second mask pixel is. In such a case, the determinator preferably determines a gradation of the first mask pixel by multiplying the gradation of the edge pixel by a first coefficient k1, where k1 is a positive real number less than 1, and preferably determines a gradation of the second mask pixel by multiplying the gradation of the edge pixel by a second coefficient k2, where k2 is a positive real number less than the first coefficient k1. This further reduces a voltage at the boundary between the edge pixel and the mask pixel.

When the gradation of each of the display pixels is represented by a voltage applied thereto, a ratio of a voltage applied to the mask pixel to a voltage applied to the edge pixel may be preferably given as follows: $0.1 \leq k \leq 0.6$, where Vm represents the voltage applied to the mask pixel and where Vi represents the voltage applied to the edge pixel. This reduces the occurrence of a corner spot.

When the gradation of each of the display pixels is represented by a brightness level thereof, a ratio of a brightness level of the mask pixel to a brightness level of the edge pixel may be preferably given as follows: $0.05\% \leq (Tm/Ti) \leq 40\%$, where Tm represents the brightness level of the mask pixel and where Ti represents the brightness level of the edge pixel. This reduces the occurrence of a corner spot while keeping the mask pixel invisible.

Another aspect of the invention provides a display apparatus including a display unit, a corrector, and a determinator. The display unit has display pixels. The corrector corrects a correspondence between the display pixels of the display and data pixels on an image signal to be inputted to the plurality of display pixels so that at least one of the plurality of display pixels is defined as a mask pixel to which the image signal is no longer inputted. The determinator determines a gradation of the mask pixel in accordance with a gradation indicated by the image signal to be inputted to an edge pixel that is included in the plurality of display pixels and located at an edge of the plurality of display pixels. According to this aspect, the display apparatus corrects pixel misalignment while reducing the occurrence of a corner spot.

It is preferable that the display apparatus includes a projection unit and that the display includes multiple liquid crystal panels that modulate different color components of light. The projection unit projects the light modulated by the liquid crystal panels. This corrects pixel misalignment on an image to be projected.

Still another aspect of the invention provides an image processing method including a correcting step and a determining step. The correcting step corrects a correspondence between display pixels of a display unit and data pixels on an image signal to be inputted to the display pixels so that at least one of the display pixels is defined as a mask pixel to which the image signal is no longer inputted. The determining step determines a gradation of the mask pixel in accordance with a gradation indicated by the image signal to be inputted to an edge pixel that is included in the display pixels and located at an edge of the display pixels. According to this aspect, the image processing method corrects pixel misalignment while reducing the occurrence of a corner spot.

BRIEF DESCRIPTION OF THE DRAWINGS

The invention will be described with reference to the accompanying drawings, wherein like numbers reference like elements.

FIG. 20 is a diagram showing the result of a 200-hour illumination experiment.

FIG. 21 is a diagram illustrating a test pattern used in another experiment.

FIG. 22 is a diagram illustrating an example of a mask pixel process according to a first modification.

DESCRIPTION OF EXEMPLARY EMBODIMENTS

1. Outline

Figure 1:
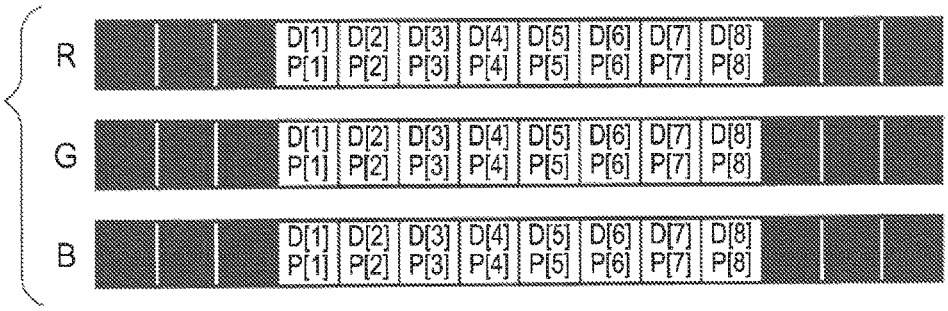
FIG. 1 is a diagram illustrating an example of the positional relationship between a display pixel and a data pixel.

FIG. 1 is a diagram illustrating an example of the positional relationship between a display pixel and a data pixel. Terms used in the specification are defined as follows. The term "display pixel" refers to a pixel having a structure capable of changing its gradation to display an image in accordance with an input signal including an image signal. The term "image pixel" refers to the display pixel to which the image signal is inputted. The term "mask pixel" refers to the display pixel to which the image signal is no longer inputted as a result of a pixel misalignment correction process. The mask pixel is controlled to have a predetermined gradation (e.g., a gradation corresponding to black) that does not interfere with a displayed image. The term "edge pixel" refers to the image pixel adjacent to the mask pixel. The term "cut-off pixel" refers to the display pixel provided near the image pixel. The cut-off pixel is normally controlled to have a predetermined gradation (e.g., a gradation corresponding to black) that does not interfere with a displayed image. The term "dummy pixel" refers to a pixel having a structure which is similar to that of the display pixel but incapable of changing its gradation depending on the image signal due to, for example, being covered with a light blocking coating. Since having such a structure as being covered with a light blocking coating, the dummy pixel is visible in black. The term "data pixel" refers to a pixel as data on the image signal.

A projector that uses an electro-optical device, such as a liquid crystal panel, as an optical modulator is taken as an example to describe a display apparatus according to an embodiment. FIG. 1 shows pixels that form one line projected on a screen. For the sake of convenience, the one line is illustrated in FIG. 1 as being divided into three rows. Actually, the pixels shown in FIG. 1 form the same row. In this example, eight display pixels are arranged for each color component. The display pixels in the first row display red (R). The display pixels in the second row display green (G). The display pixels in the third row display blue (B). FIG. 1 shows a condition where no pixels are misaligned. The image signal indicates the gradation of each pixel in a matrix with one row and eight columns for each color component. Three dummy pixels are provided at both the right and left ends of each row.

In FIG. 1, P[i] refers to the display pixel in the "i" column, and D[j] refers to data assigned to the data pixel in the "j" column, where "i" and "j" represent an integer from 1 to 8. The notation "D[j]/P[i]" in each pixel means that the data D[j] is assigned to the display pixel P[i]. For example, the notation "D[0]/P[1]" means that data D[1] is assigned to a display pixel P[1]. Since FIG. 1 shows a condition where a pixel misalignment correction process is not applied, the integer "i" is equal to the integer "j" (i.e., i=j).

Figure 2:
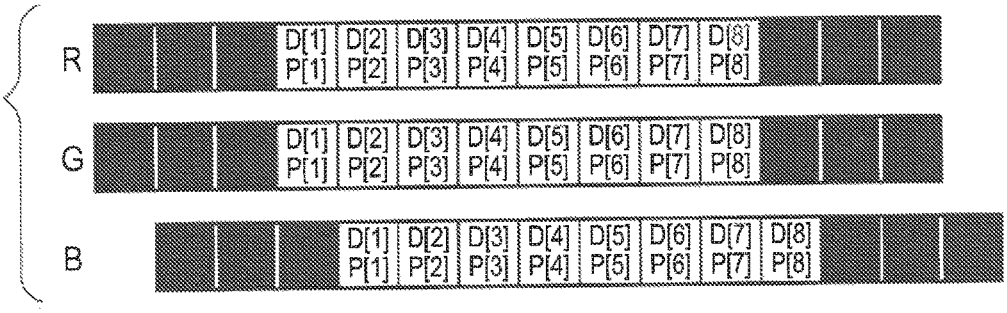
FIG. 2 is a diagram illustrating another example of the positional relationship between the display pixel and the data pixel.

FIG. 2 is a diagram illustrating another example of the positional relationship between the display pixels and the data pixels. This example illustrates a condition where a pixel misalignment occurs in the third row for the blue (B) component. Specifically, pixels in the third row are misaligned to the right by one pixel relative to those in the other rows. Such pixel misalignment can be caused by many factors, including the degradation, the deformation, and the position displacement of a projection optical system. When the pixel misalignment occurs in a manner shown in FIG. 2, the left edge becomes yellowish in color due to the lack of the blue (B) component while the right edge becomes bluish in color due to the presence of the blue (B) component. The display defect is visible accordingly. To reduce the display defect, the data pixel for the blue (B) component is shifted to the left by one pixel. This correction is referred to as the "pixel misalignment correction process".

Figure 3:
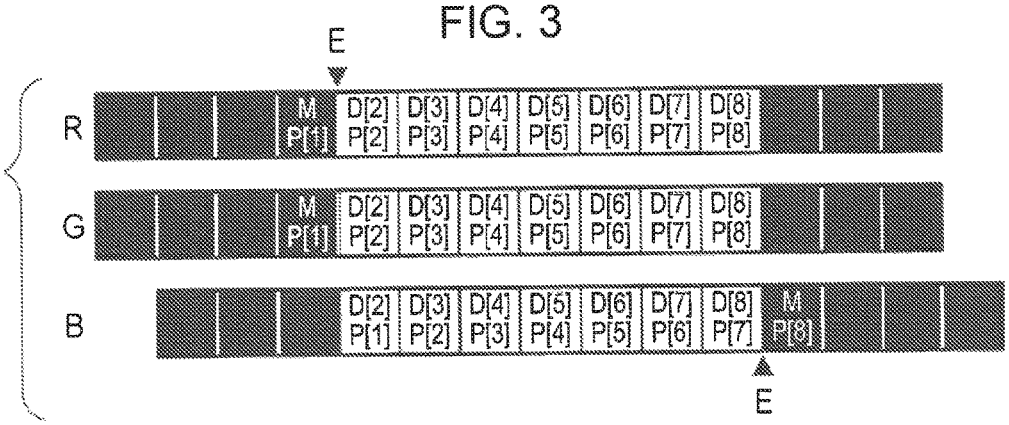
FIG. 3 is a diagram illustrating an example of a pixel misalignment correction process.

FIG. 3 is a diagram illustrating an example of the pixel misalignment correction process. When the pixel misalignment correction process is applied, each data pixel for the blue (B) component is inputted to the display pixel which is shifted by one pixel compared to when the pixel misalignment correction process is not applied. As shown in FIG. 1, when the misalignment correction process is not applied, D[i] is inputted to P[i] (i.e., P[i]=D[i]). When the pixel misalignment correction process is applied as shown in FIG. 3, D[i+1] is inputted to P[i] (i.e., P[i]=D[i+1]). For example, D[2] is inputted to P[1], and D[8] is inputted to P[7]. The display pixel P[8] at the right end for the blue (B) component has no input signal, thus becoming a mask pixel as denoted by "M" in FIG. 3. Further, the display pixel P[1] at the left end for each of the red (R) component and the green (G) component corresponds to no display pixel for the blue (B) component, thus becoming a mask pixel as denoted by "M" in FIG. 3.

In order not to interfere with an image displayed by the image pixel, the mask pixel is controlled to have a gradation corresponding to black by related techniques. As a result, a voltage at the boundary between an edge pixel and the mask pixel increases. The voltage increase may cause a corner spot which is an uneven gradation distribution occurring at the corners of the displayed image.

Figure 4:
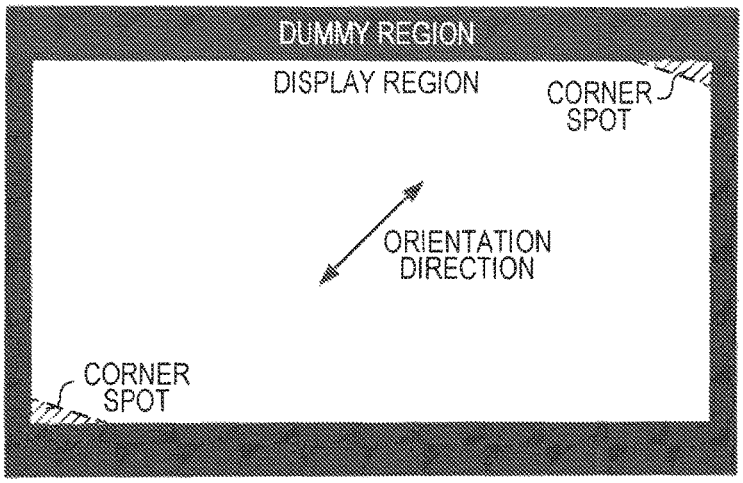
FIG. 4 is a diagram illustrating an example of a corner spot.

FIG. 4 is a diagram illustrating an example of a corner spot. A corner spot is caused, for example, by ionic impurities that are moved by the voltage between the edge pixel and the mask pixel and that are gathered at the corners of an electro-optical panel. The ionic impurities are moved, for example, along the direction in which liquid crystal molecules are oriented. In the example shown in FIG. 4, liquid crystal molecules are oriented at an angle of 45 degrees in the direction from the bottom-left to the top-right of the panel. Accordingly, a corner spot occurs at the bottom-left corner and at the top-right corner of the panel. In FIG. 4, a display region is formed by the image pixel, and a dummy region is formed by the mask pixel, a cut-off pixel, and the dummy pixel. An embodiment to reduce the occurrence of a corner spot is described below.

2. Configuration

Figure 5:
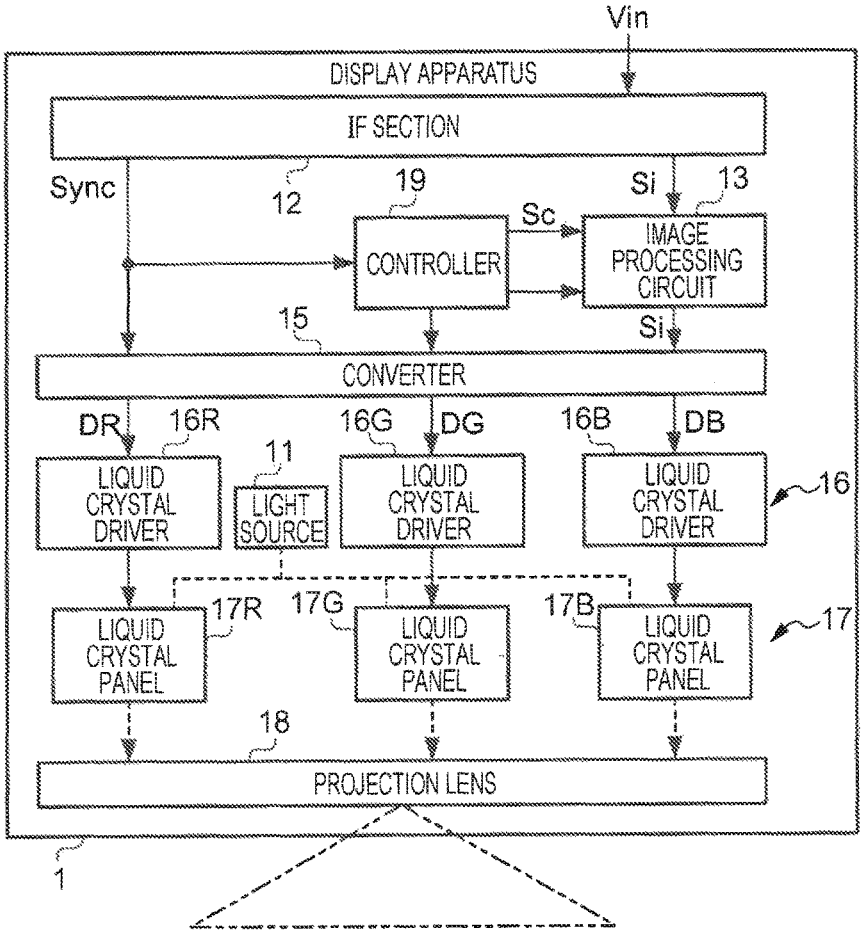
FIG. 5 is a diagram illustrating an example configuration of a display apparatus 1 according to an embodiment.

FIG. 5 is a diagram illustrating an example configuration of a display apparatus 1 according to an embodiment. The display apparatus 1 is a projector that projects an image on a screen. The display apparatus 1 includes a light source 11, an interface (IF) section 12, an image processing circuit 13, a converter 15, a liquid crystal driver 16, a liquid crystal panel 17, a projection lens 18, and a controller 19.

The light source 11 emits light used to display the image. The light source 11 has a lamp or a solid state light source. Examples of the lamp include a high-pressure mercury lamp, a halogen lamp, and a metal halide lamp. Examples of the solid state light source include a light emitting diode (LED) and a laser diode. The light source 11 further has a driving circuit for the lamp or the solid state light source. The light emitted by the light source 11 is split by a spectroscopic optical system (not shown) into multiple color components, and the color components are modulated separately. According to the present embodiment, the light is split into three color components: red (R), green (G), and blue (B).

The IF section 12 serves as an interface that allows the exchange of data between the display apparatus 1 and an external apparatus. For example, the IF section 12 has at least one of the followings. A video graphics array (VGA) port, a universal serial bus (USB) port, a wired local area network (LAN) interface, a separate (S) port, an RCA jack, a high-definition multimedia interface (HDMI, a registered trademark of HDMI Licensing LLC) port, a microphone jack, and a wireless LAN interface. According to the present embodiment, the IF section 12 serves as an image input interface. Alternatively, the IF section 12 may double as an image output interface. The IF section 12 receives an image signal Vin from an external apparatus (not shown) and outputs an image signal Si and a synchronization signal Sync. The image signal Si indicates the gradation of each of pixels for each color component. The synchronization signal Sync indicates the timing of synchronization between the data pixel and the display pixel and has, for example, both a horizontal synchronization signal and a vertical synchronization signal.

The image processing circuit 13 applies predetermined image processing, such as resizing or keystone correction, to the image signal Si. The converter 15 outputs the synchronization signal Sync that indicates the timing to drive the liquid crystal panel 17. Further, the converter 15 converts the image signal Si into a signal form that can be processed by the liquid crystal driver 16. According to the present embodiment, the converter 15 converts the image signal Si into data signals DR, DG, and DB. The liquid crystal driver 16 outputs a drive signal to drive the liquid crystal panel 17 in accordance with the data signals DR, DG, and DB. As such, the optical state of each pixel in the liquid crystal panel 17 is determined in accordance with the image signal Si. The liquid crystal panel 17 is an example of an optical modulator that modulates projection light. According to the present embodiment, the liquid crystal panel 17 has multiple display pixels arranged in a matrix. Further, the liquid crystal driver 16 and the liquid crystal panel 17 are divided into sets for each color component. Specifically, the liquid crystal driver 16 includes liquid crystal drivers 16R, 16G, and 16B, and the liquid crystal panel 17 includes liquid crystal panels 17R, 17G, and 17B. The set of the liquid crystal driver 16R and the liquid crystal panel 17R is provided corresponding to the red (R) component, the set of the liquid crystal driver 16G and the liquid crystal panel 17G is provided corresponding to the green (G) component, and the set of the liquid crystal driver 16B and the liquid crystal panel 17B is provided corresponding to the blue (B) component.

The liquid crystal panels 17R, 17G, and 17B modulate the light emitted by the light source 11 to create their respective color images. The modulated light beams are combined and then projected on a screen by the projection lens 18.

The controller 19 controls the components of the display apparatus 1 and includes a central processing unit (CPU) and a memory module. The controller 19 outputs a control signal Sc. The control signal Sc specifies a method to determine the gradation of the mask pixel. According to the present embodiment, the method of determining the gradation of the mask pixel includes a voltage correction method based on a voltage and a brightness correction method based on a brightness level. The control signal Sc specifies which of the two methods is used to determine the gradation of the mask pixel. The controller 19 controls the operation of the image processing circuit 13.

Figure 6:
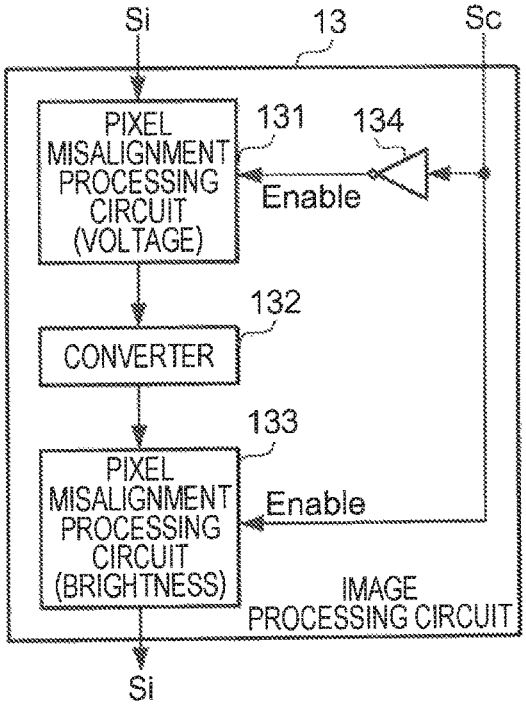
FIG. 6 is a diagram illustrating an example configuration of an image processing circuit.

FIG. 6 is a diagram illustrating the configuration of the image processing circuit 13. The image processing circuit 13 performs a pixel misalignment correction process. The image processing circuit 13 includes a pixel misalignment processing circuit 131, a converter 132, a pixel misalignment processing circuit 133, and an inverter 134. According to the present embodiment, the image signal Si to be inputted to the image processing circuit 13 indicates a voltage depending on a gradation. That is, the image signal Si indicates the gradation of each pixel as a voltage to be applied to the pixel.

The pixel misalignment processing circuit 131 performs a pixel misalignment process including a gradation determination process that uses the voltage correction method to determine the gradation of the mask pixel. When receiving a logic high signal as an enable signal Enable, the pixel misalignment processing circuit 131 applies the pixel misalignment process to the inputted image signal Si. In contrast, when receiving a logic low level as the enable signal Enable, the pixel misalignment processing circuit 131 outputs the inputted image signal Si without applying the pixel misalignment process to the inputted image signal Si.

The converter 132 converts the image signal Si indicative of the voltage of each pixel into a brightness signal indicative of the brightness level of each pixel. When the liquid crystal panel 17 is a transmissive liquid crystal panel, the brightness level of a pixel refers to the transmittance of the pixel. When the liquid crystal panel 17 is a reflective liquid crystal panel, the brightness level of a pixel refers to the reflectance of the pixel. According to the present embodiment, the liquid crystal panel 17 is a transmissive liquid crystal panel. The converter 132 stores a conversion table which is set in accordance with voltage-transmittance (V-T) characteristics of the liquid crystal panel 17. The converter 132 converts a voltage into a brightness level by referring to the conversion table.

The pixel misalignment processing circuit 133 performs the pixel misalignment process including the gradation determination process that uses the brightness correction method to determine the gradation of the mask pixel. When receiving the high level signal as the enable signal, the pixel misalignment processing circuit 133 performs the pixel misalignment correction on the inputted image signal Si. In contrast, when receiving the low level signal as the enable signal, the pixel misalignment processing circuit 133 outputs the inputted image signal Si without performing the pixel misalignment correction.

The control signal Sc is logic high when the gradation of the mask pixel is to be determined by the brightness correction method. In contrast, the control signal Sc is logic low when the gradation of the mask pixel is to be determined by the voltage correction method. The inverter 134 inverts the logic level of the control signal Sc to be inputted as the enable signal Enable to the pixel misalignment processing circuit 131. In contrast, the logic level of the control signal Sc remains unchanged when the control signal Sc is inputted as the enable signal Enable to the pixel misalignment processing circuit 133.

Figure 7:
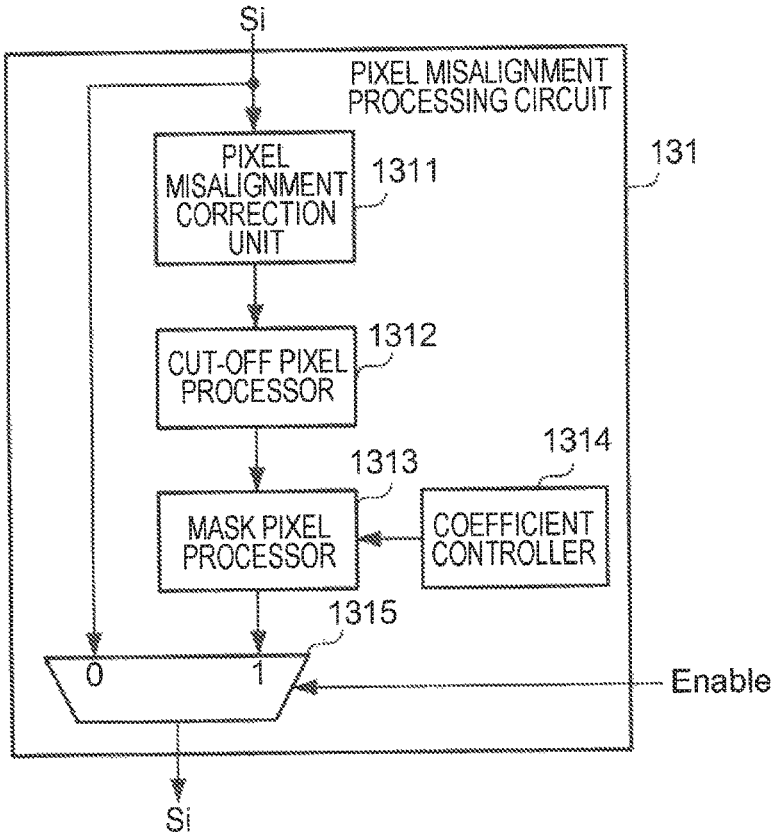
FIG. 7 is a diagram illustrating an example configuration of a pixel misalignment processing circuit.

FIG. 7 is a diagram illustrating an example configuration of the pixel misalignment processing circuit 131. The pixel misalignment processing circuit 131 performs a pixel misalignment correction process to correct the correspondence between the data pixel and the display pixel, a cut-off pixel process to determine the gradation of the cut-off pixel, and a mask pixel process to determine the gradation of the mask pixel. The pixel misalignment processing circuit 131 includes a pixel misalignment correction unit 1311, a cut-off pixel processor 1312, and a mask pixel processor 1313, a coefficient controller 1314, and a selector 1315.

The pixel misalignment correction unit 1311 performs the pixel misalignment correction process. As already described with reference to FIG. 3, the pixel misalignment correction process causes the correspondence between part of the display pixels of the display apparatus 1 and the data pixels to differ from the correspondence between the remaining part of the display pixels and the data pixels. In the example shown in FIG. 3, D[i+1] is inputted to P[i] for the blue (B) component as the result of the pixel misalignment correction process having been applied, compared to when the pixel misalignment correction process is not applied so that D[i] is inputted to P[i]. As already described, the notation "P[i]" represents the display pixel, and the notation "D[i]" represents the data pixel. It is noted that the presence or absence of the pixel misalignment and the degree of the pixel misalignment are pre-detected by a predetermined detection process. For example, the detection process projects a test pattern image on the screen, captures the image projected on the screen with a camera, and analyzes the image captured with the camera, thereby detecting how many pixels of each color component are misaligned. The detected information is prestored in a memory module (not shown) of the display apparatus 1.

In the pixel misalignment correction process, the pixel misalignment correction unit 1311 shifts the timing between a horizontal synchronization signal Hsync and the image signal Si by an amount corresponding to the pixel misalignment. For example, when the data pixel needs to be shifted to the left by one pixel relative to the display pixel, the pixel misalignment correction unit 1311 delays the horizontal synchronization signal Hsync relative to the image signal by one clock cycle. In contrast, when the data pixel needs to be shifted to the right by one pixel relative to the display pixel, the pixel misalignment correction unit 1311 delays the image signal relative to the horizontal synchronization signal Hsync by one clock cycle.

The cut-off pixel processor 1312 performs the cut-off pixel process. The display pixel to be set as the cut-off pixel is determined by, for example, the controller 19. In the cut-off pixel process, the cut-off pixel processor 1312 processes the image signal Si so that the gradation of the cut-off pixel can correspond to black. If the liquid crystal panel 17 has no cut-off pixel, the cut-off pixel processor 1312 outputs the inputted image signal Si without any processing.

The mask pixel processor 1313 performs the mask pixel process. According to the present embodiment, the mask pixel process determines the gradation of the mask pixel by multiplying the gradation of the edge pixel by a predetermined coefficient.

Figure 8:
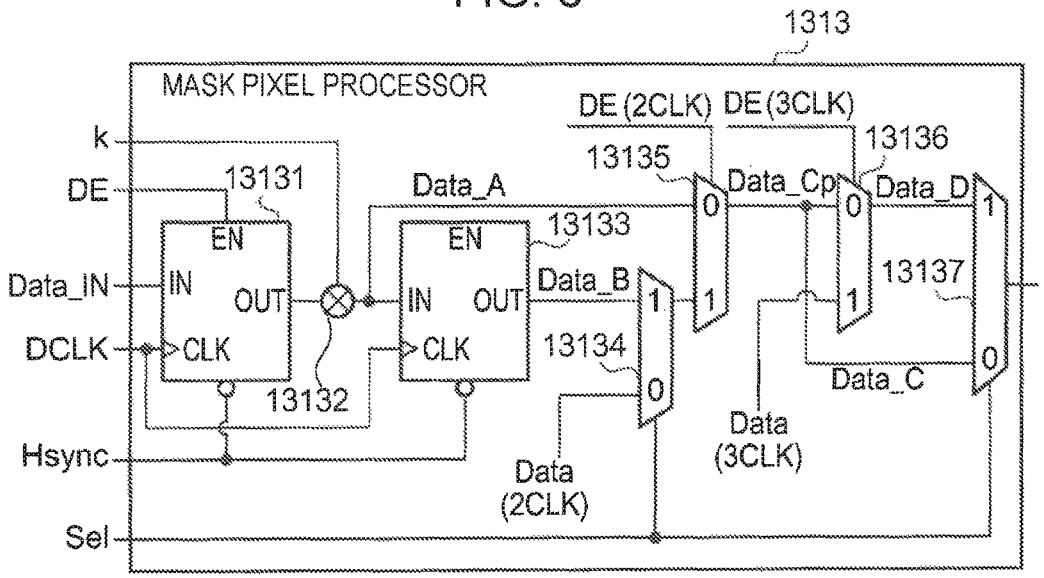
FIG. 8 is a diagram illustrating an example configuration of a mask pixel processor.
Figure 9:
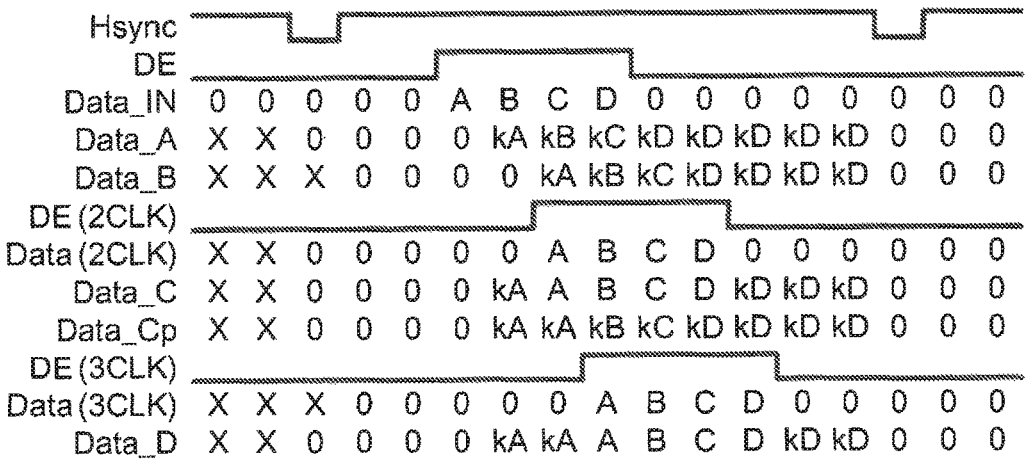
FIG. 9 is a diagram illustrating an example of the timing chart of the mask pixel processor.

FIG. 8 is a diagram illustrating an example configuration of the mask pixel processor 1313. FIG. 9 is a diagram illustrating an example of the timing chart of the mask pixel processor 1313. The mask pixel processor 1313 has a delay flip flop (D-FF) 13131, a multiplier 13132, a D-FF 13133, a selector 13134, a selector 13135, a selector 13136, and a selector 13137.

An image signal Data-IN is inputted to the mask pixel processor 1313. For the sake of simplicity, the image signal Data-IN shown in FIG. 9 has data (denoted as A, B, C, and D) for only four pixels. A signal DE indicates a period when the image signal Data_IN has the data pixel. Specifically, the signal DE is logic high during a period when the image signal Data_IN has the data pixel, and is logic low during the remaining period. A clock signal DCLK defines the time when the mask pixel processor 1313 operates. The clock signal DCLK defines the time length of one pixel. A coefficient signal k indicates the coefficient used in the mask pixel process. The coefficient signal k is supplied from the coefficient controller 1314. A selection signal Se indicates the number of steps in the delay process, namely, the number of the mask pixels (i.e., the number of pixels by which the data pixel and the display pixel are shifted from each other). According to the present embodiment, the mask pixel processor 1313 is effective when the number of pixels by which the data pixel and the display pixel are shifted from each other is one or two. The selection signal Se is logic low when the number of pixels by which the data pixel and the display pixel are shifted from each other is one, and is logic high when the number of pixels by which the data pixel and the display pixel are shifted from each other is two. The horizontal synchronization signal Hsync indicates the timing of synchronization in the horizontal direction of the image.

The D-FF 13131 delays the image signal Data_IN by one clock cycle, thereby generating an output signal. Further, the D-FF 13131 stores data on the falling edge of the signal DE. The multiplier 13132 multiplies the output signal of the D-FF 13131 by a coefficient k indicated by the coefficient signal k, thereby outputting an image signal Data_A. The image signal Data_A outputted from the multiplier 13132 is divided into two signals; one of which is inputted to the D-FF 13133; the other of which is inputted to the selector 13135.

The D-FF 13133 delays the image signal Data_A by one clock cycle, thereby outputting an image signal Data_B. The image signal Data_B outputted from the D-FF 13133 and an image signal Data(2CLK) are inputted to the selector 13134. The image signal Data(2CLK) is a signal generated by delaying the image signal Data_IN by two clock cycles. When the selection signal Sel is logic low, the selector 13134 outputs the image signal Data(2CLK). When the selection signal Sel is logic high, the selector 13134 outputs the image signal Data_B. Each of the D-FF 13131 and the D-FF 13133 reset data to output when the horizontal synchronization signal Hsync changes to logic low.

The image signal Data_A and the output signal of the selector 13134 are inputted to the selector 13135. In addition, a signal DE(2CLK) is inputted as a selection signal to the selector 13135. The signal DE(2CLK) is generated by delaying the signal DE by two clock cycles. When the signal DE(2CLK) is logic low, the selector 13135 outputs the image signal Data_A. When the signal DE(2CLK) is logic high, the selector 13135 outputs the output signal of the selector 13134. The output signal of the selector 13135 is divided into two signals; one of which is inputted to the selector 13136; the other of which is inputted to the selector 13137. The signal inputted to the selector 13136 is the same as the signal inputted to the selector 13137. For the sake of convenience, the signal inputted to the selector 13136 is referred to as the "image signal Data_Cp", and the signal inputted to the selector 13137 is referred to as the "image signal Data_C". For the operation of the selector 13136 and the selector 137, the image signal Data_Cp is effective when the selection signal Sel is logic high, and the image signal Data_C is effective when the selection signal Sel is logic low. As such, when one of the image signal Data_Cp and the image signal Data_C is effective, the other is ineffective. Therefore, the image signal Data_Cp and the image signal Data_C are considered as separate signals.

The image signal Data_Cp and an image signal Data (3CLK) are inputted to the selector 13136. The image signal Data(3CLK) is a signal generated by delaying the image signal Data_IN by three clock cycles. In addition, a signal DE(3CLK) is inputted as a selection signal to the selector 13136. The selection signal DE(3CLK) is a signal generated by delaying the signal DE by three clock cycles. When the signal DE(3CLK) is logic low, the selector 13136 outputs the image signal Data_Cp. When the signal DE(3CLK) is logic high, the selector 13136 outputs the image signal Data(3CLK).

An output signal Data_D of the selector 13136 and the image signal Data_C are inputted to the selector 13137. In addition, the selection signal Sel is inputted to the selector 13136. When the selection signal Sel is logic low, the selector 13137 outputs the image signal Data_C. When the selection signal Sel is logic high, the selector 13137 outputs the image signal Data_D. An output signal of the selector 13137 is outputted as an image signal Data_Out from the mask pixel processor 1313.

In the image signal Data_C and the image signal Data_D, a value calculated by multiplying the gradation of the edge pixel by the coefficient k is set to the gradation of the mask pixel. For example, the gradation of the mask pixel adjacent to the edge pixel having the gradation of "A" is set to "kA". In the image signal Data_C, one pixel adjacent to the edge pixel is processed as the mask pixel. In the image signal Data_D, two pixels adjacent to the edge pixel are processed as the mask pixels.

Referring back to FIG. 7, the image signal Data_Out and the image signal Si are inputted to the selector 1315. In addition, an enable signal Enable is inputted as a selection signal to the selector 1315. When the enable signal Enable is logic high, the selector 1315 outputs the Data_Out, namely, the image signal Si having undergone the pixel misalignment process. When the enable signal Enable is logic low, the selector 1315 outputs the image signal Si having not undergone the pixel misalignment process.

Although the configuration of the pixel misalignment processing circuit 133 is not described here, the pixel misalignment processing circuit 133 has the same configuration as that of the pixel misalignment processing circuit 131 shown in FIG. 7.

The liquid crystal panel 17 is an example of a display unit for displaying an image. The projection lens 18 is an example of a projection unit for projecting light modulated by the display unit. The pixel misalignment correction unit 1311 is an example of a corrector for correcting the correspondence between display pixels of the display unit and data pixels on an image signal. The mask pixel processor 1313 is an example of a determinator for determining the gradation of a mask pixel in accordance with a gradation indicated by the image signal inputted to an edge pixel. The pixel misalignment processing circuit 131 is an example of an image processing apparatus having the corrector and the determinator.

3. Operation Examples

Figure 10:
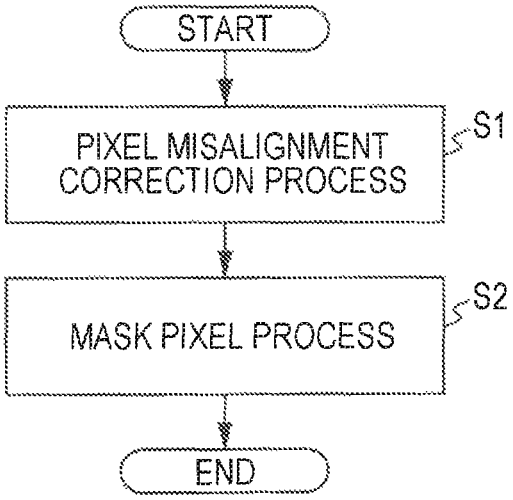
FIG. 10 is a flowchart of the operation of the pixel misalignment processing circuit.

FIG. 10 is a flowchart of the operation of the pixel misalignment processing circuit 131. At step S1, the pixel misalignment correction unit 1311 applies the pixel misalignment correction process to an image signal. At step S2, the mask pixel processor 1313 applies the mask pixel process to the image signal having undergone the pixel misalignment correction process.

3-1. First Operation Example

Figure 11:
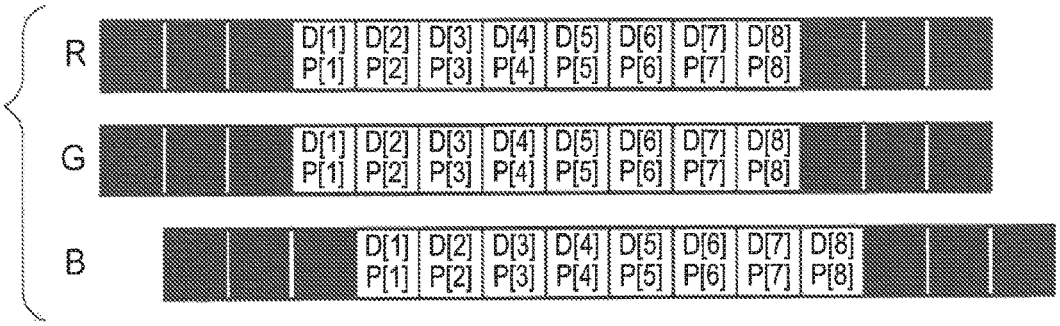
FIG. 11 is a diagram illustrating pixel misalignment related to a first operation example.

FIG. 11 is a diagram illustrating pixel misalignment related to a first operation example. It is noted that FIGS. 11 to 19 which are referred to describe operation examples including the first operation example show pixels that form one line projected on the screen. For the sake of convenience, the one line is illustrated in FIGS. 11 to 19 as being divided into three rows. The first row from the top indicates a display image of the red (R) component. The second row indicates a display image of the green (G) component. The first row indicates a display image of the blue (B) component. The liquid crystal panel 17 has eight display pixels in each row, and three dummy pixels are provided at both the right and left ends of each row. In this example, the liquid crystal panel 17 has no cut-off pixels. In this example, pixels of the blue (B) component are misaligned to the right by one pixel relative to those of the red (R) component and the green (G) component. The liquid crystal panel 17 is a normally black liquid crystal panel.

Figure 12:
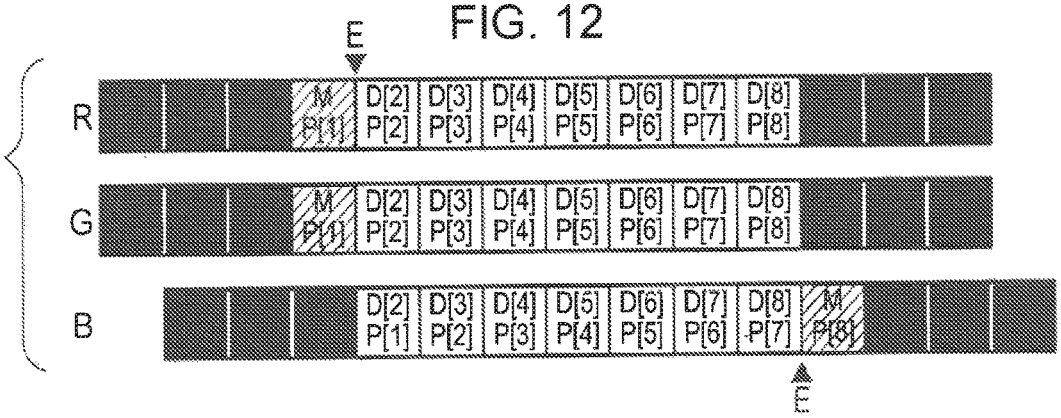
FIG. 12 is a diagram illustrating an example of a mask pixel process according to the first operation example.

FIG. 12 is a diagram illustrating an example of the mask pixel process according to the first operation example. First, the pixel misalignment correction process shifts each data pixel of the blue (B) component to the left by one pixel. As a result of the pixel misalignment correction process, the display pixel P[8] of the blue component (B), which is an image pixel before the pixel misalignment correction process has been applied, changes to a mask pixel. Further, the display pixel P[1] of each of the red (R) component and the green (G) component, which is an image pixel before the pixel misalignment correction process has been applied, changes to a mask pixel. It is noted that FIG. 12 shows a case where every image pixel has a gradation corresponding to white. Then, the gradation of the display pixel P[8] of the blue (B) component, which is a mask pixel, is calculated by multiplying the gradation of the display pixel P[7] (the data pixel D[8]) of the blue (B) component, which is an edge pixel, by the coefficient k. For the red (R) and green (G) components, the gradation of the display pixel P[1] as a mask pixel is calculated by multiplying the gradation of the display pixel P[2] (the data pixel D[2]) as an edge pixel by the coefficient k. For example, the coefficient k is greater than 0 and less than 1 (i.e., 0<k<1). When the coefficient k is, for example, 0.5, the gradation of the mask pixel is 50% of the gradation of the edge pixel. The term "gradation" refers to a voltage when the gradation of the mask pixel is to be determined by the voltage correction method, and refers to a brightness level when the gradation of the mask pixel is to be determined by the brightness correction method.

This process reduces a voltage at a boundary E between the mask pixel and the edge pixel (i.e., the boundary between the pixels P[7] and P[8] of the blue (B) component and the boundary between the pixels P[1] and P[2] of each of the green (G) component and the red (R) component), compared to related-art techniques that always change the gradation of the mask pixel to black without any consideration of the gradation of the edge pixel. The reduction in the voltage reduces the occurrence of a corner spot accordingly. Further, since the gradation of the mask pixel is set so that the mask pixel is darker than the edge pixel, color misalignment occurring at both ends of an image becomes less visible than the condition shown in FIG. 11.

Figure 13:
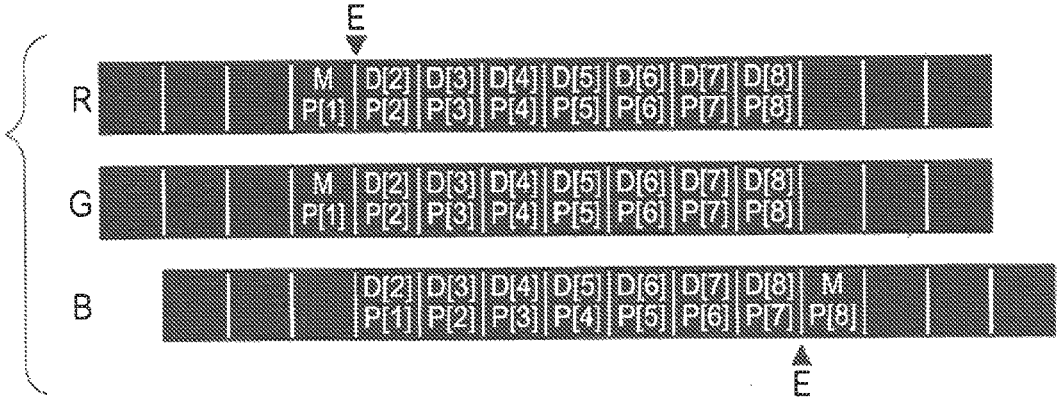
FIG. 13 is a diagram illustrating another example of the mask pixel process according to the first operation example.

FIG. 13 is a diagram illustrating another example of the mask pixel process according to the first operation example. In the example shown in FIG. 3, every image pixel has a gradation corresponding to black. The gradation of the mask pixel is calculated by multiplying the gradation of the edge pixel by the coefficient k and consequently corresponds to black. In the first operation example described above, the number of columns for the image pixel of each color component is reduced from 8 to 7 as the result of the pixel misalignment correction process, resulting in a reduction in resolution.

3-2. Second Operation Example

Figure 14:
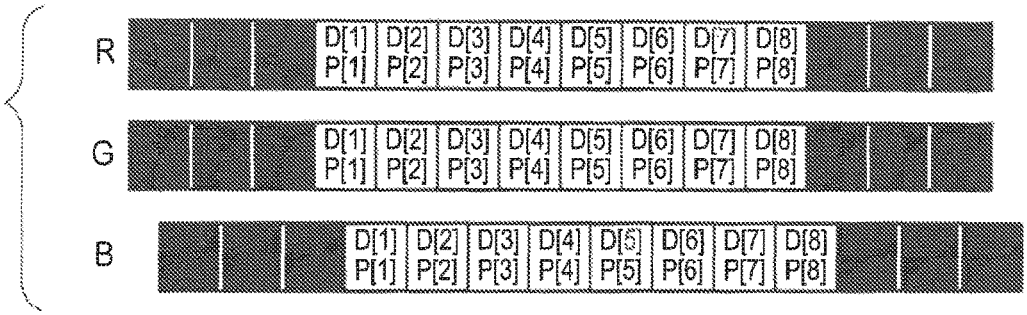
FIG. 14 is a diagram illustrating pixel misalignment related to a second operation example.
Figure 15:
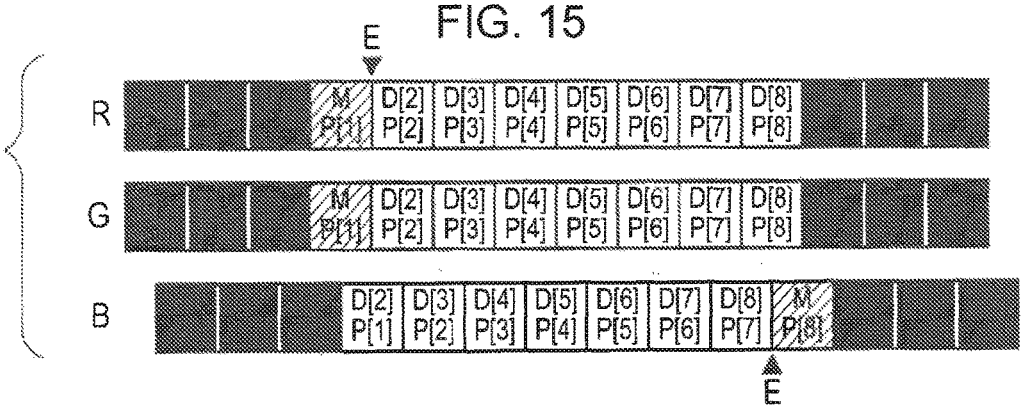
FIG. 15 is a diagram illustrating an example of a mask pixel process according to the second operation example.
Figure 16:
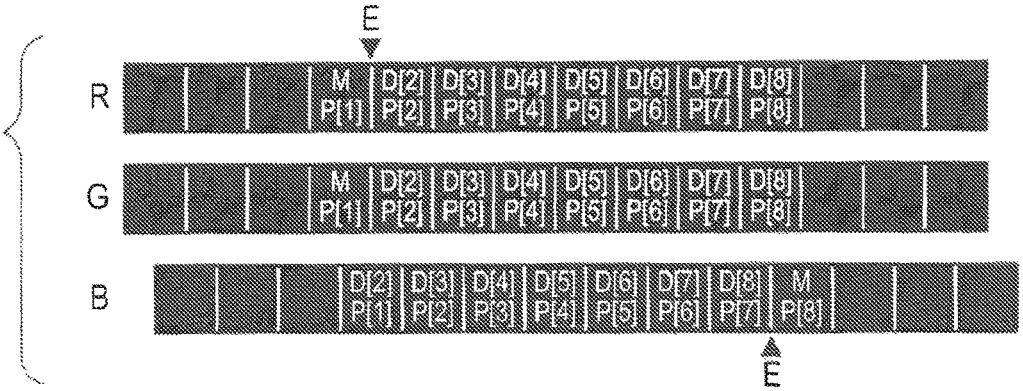
FIG. 16 is a diagram illustrating another example of the mask pixel process according to the second operation example.

FIG. 14 is a diagram illustrating pixel misalignment related to a second operation example. FIG. 15 is a diagram illustrating an example of the mask pixel process according to the second operation example. FIG. 16 is a diagram illustrating another example of the mask pixel process according to the second operation example. In the second operation example, pixels of the blue (B) component are misaligned to the right by a half pixel (i.e., 0.5 pixel) relative to those of the red (R) component and the green (G) component. Since the pixel misalignment correction process can be applied only one pixel at a time, each data pixel of the blue component (B) is shifted to the left by one pixel. As a result of the pixel misalignment correction process, the display pixel P[8] of the blue component (B), which is an image pixel before the pixel misalignment correction process has been applied, changes to a mask pixel. Further, the display pixel P[1] of each of the red (R) component and the green (G) component, which is an image pixel before the pixel misalignment correction process has been applied, changes to a mask pixel. Thus, the pixel misalignment correction process and the mask pixel process work in the same manner between the first operation example and the second operation example regardless of the degree of the pixel misalignment.

3-3. Third Operation Example

Figure 17:
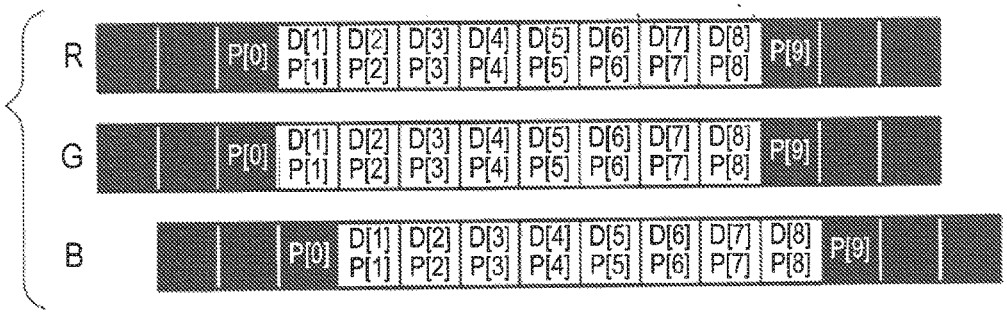
FIG. 17 is a diagram illustrating pixel misalignment related to a third operation example.

FIG. 17 is a diagram illustrating pixel misalignment related to a third operation example. In the example shown in FIG. 17, the liquid crystal panel 17 has display pixels P[0] and P[9] serving as cut-off pixels. The display pixel P[0] is provided at the left end of the display pixels in each row, and the display pixel P[9] is provided at the right end of the display pixels in each row. The liquid crystal panel 17 further has two columns of dummy pixels which are provided adjacent to and outside each cut-off pixel. In the third operation example, pixels of the blue (B) component are misaligned to the right by one pixel relative to those of the red (R) component and the green (G) component.

Figure 18:
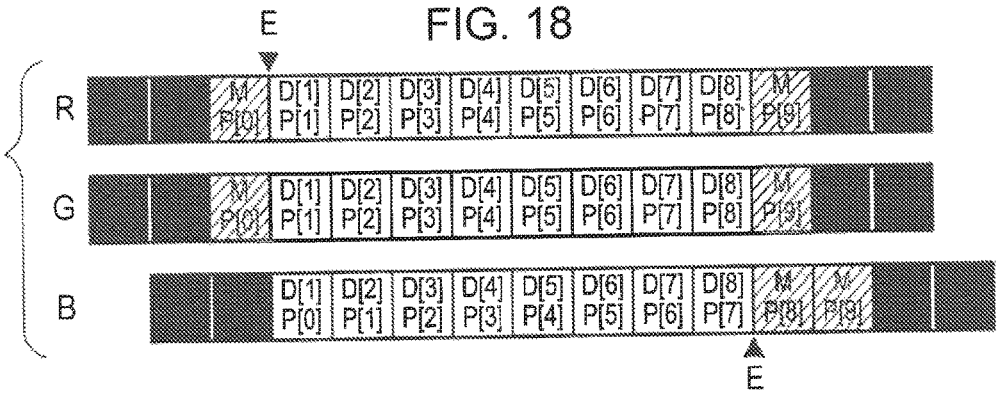
FIG. 18 is a diagram illustrating an example of a mask pixel process according to the third operation example.
Figure 19:
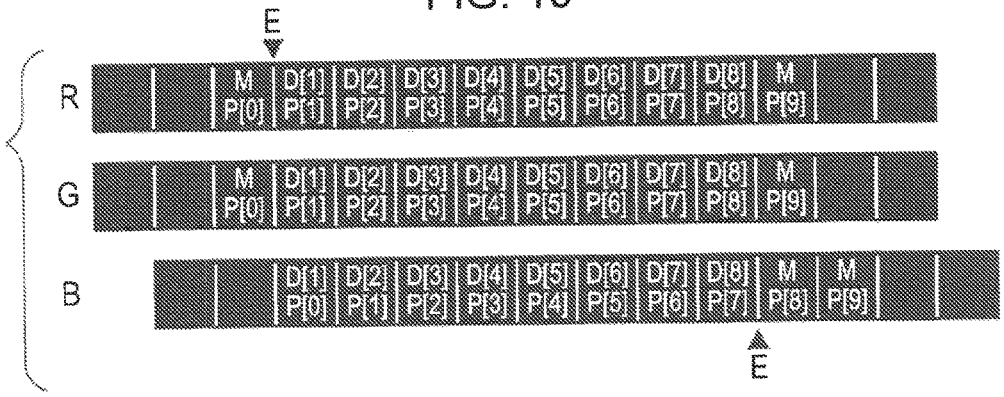
FIG. 19 is a diagram illustrating another example of the mask pixel process according to the third operation example.

FIGS. 18 and 19 are diagrams illustrating examples of the mask pixel process according to the third operation example. First, the pixel misalignment correction process shifts each data pixel of the blue component (B) to the left by one pixel. As a result of the pixel misalignment correction process, the display pixel P[0] of the blue component (B) is supplied with a data pixel D[1] and changes from a cut-off pixel to an image pixel. Further, the display pixel P[8] of the blue component (B), which is an image pixel before the pixel misalignment correction process has been applied, changes to a mask pixel, and the display pixel P[9] of the blue component (B), which is a cut-off pixel before the pixel misalignment correction process has been applied, also changes to a mask pixel. Further, the display pixels P[0] and P[9] of each of the red (R) component and the green (G) component, which are image pixels before the pixel misalignment correction process has been applied, change to mask pixels. In the example shown in FIG. 18, every image pixel has a gradation corresponding to white. For the blue (B) component, the gradation of each of the display pixels P[8] and P[9] as mask pixels is calculated by multiplying the gradation of the display pixel P[7] (the data pixel D[8]) as an edge pixel by the coefficient k. For the red (R) and green (G) components, the gradation of the display pixel P[0] as a mask pixel is calculated by multiplying the gradation of the display pixel P[1] (the data pixel D[1]) as an edge pixel by the coefficient k. The gradation of the display pixel P[9] as a mask pixel is calculated by multiplying the gradation of the display pixel P[8] (the data pixel D[1]) as an edge pixel by the coefficient k. In the example shown in FIG. 19, every image pixel has a gradation corresponding to black.

The third operation example uses the cut-off pixel as the image pixel, thus reducing a reduction in resolution.

4. Experimental Examples

The inventor of the invention conducted an experiment to examine whether a corner spot occurs by setting the coefficient k as a parameter to various values. The experiment was conducted as follows. All pixels of a normally black, vertical alignment (VA) liquid crystal panel had a voltage (5.0 volts) applied thereto corresponding to white (i.e., the maximum gradation) and kept illuminated continuously for two hundred hours. Then, a visual inspection of whether a corner spot occurred after the two-hundred-hour illumination was conducted.

FIG. 20 is a diagram showing the result of the two-hundred-hour illumination experiment. In this experiment, the coefficient k was changed in a range from 0 to 0.6. When the coefficient k was set to 0.2, 0.3, 0.4, 0.5, and 0.6 (the first to fifth experimental examples), a corner spot was invisible. When the coefficient k was set to 0.1 (the sixth experimental example), a corner spot was lightly visible. When the coefficient k was set to 0 (the seventh experimental example), namely, when not according to the present embodiment, a corner spot was visible. The experiment result indicates that in order to reduce the occurrence of a corner spot, the coefficient k is preferably set to 0.1 or more, and more preferably set to 0.2 or more. In the liquid crystal display used in the experiment, when the coefficient k was set to 0.1, the brightness of the mask pixel was about 0.05% of that of the image pixel. Therefore, to reduce the occurrence of a corner spot, it is preferable that the following condition (1) is satisfied:

$$0.05\% \leq (Tm/Ti) \quad (1),$$

where Tm represents the brightness of the mask pixel, and Ti represents the brightness of the edge pixel.

The inventor of the invention conducted another experiment to determine a condition that makes the mask pixel invisible by setting the intensities of the image pixel and the mask pixel as parameters to various values.

FIG. 21 is a diagram illustrating a test pattern used in the experiment. In the test pattern, image pixels alternate every row between the brightness Ti and the brightness corresponding to white. The inventor of the invention set the brightness Ti to various values and conducted a visual inspection of whether the mask pixel is visible. The result of this inspection indicates that the mask pixel is invisible when the following condition (2) is satisfied:

$$(Tm/Ti) \leq 40\% \quad (2),$$

where when (Tm/Ti) is 40%, the coefficient k is 0.6.

In conclusion, the experiment results shown in FIGS. 20 and 21 indicate that the coefficient k preferably satisfies the following condition (3):

$$0.1 \leq k \leq 0.6 \quad (3)$$

Besides, the brightness ratio (Tm/Ti) of the mask pixel to the edge pixel preferably satisfies the following condition (4):

$$0.05\% \leq (Tm/Ti) \leq 40\% \quad (4)$$

5. Modifications

The above embodiment can be modified in various ways. Modifications are described below. The modifications described below may be used in combination with each other.

5-1. First Modification

Multiple mask pixels may be provided corresponding to one edge pixel. In such a case, the intensities of the mask pixels can be determined by multiplying the gradation of the edge pixel by different coefficients.

FIG. 22 is a diagram illustrating the mask pixel process according to a first modification. In the example shown in FIG. 22, two mask pixels M[1] and M[2] are provided corresponding to an edge pixel P[6], and the mask pixel M[1] is located closer to the edge pixel P[6] than the mask pixel M[2] is. The gradation of the mask pixel M[1] is determined by multiplying the gradation of the edge pixel P[6] by a first coefficient k1, and the gradation of the mask pixel M[2] is determined by multiplying the gradation of the edge pixel P[6] by a second coefficient k2. The first coefficient k1 is greater than the second coefficient k2 (i.e., k2<k1). According to the first modification, a voltage at the boundary between the edge pixel and the mask pixel can be further reduced.

5-2. Second Modification

The method of determining the gradation of the mask pixel is not limited to that described in the embodiment. For example, the gradation of the mask pixel can be determined by subtracting a predetermined value from the gradation of the edge pixel. In this case, the gradation of the mask pixel is processed so as not to become negative.

5-3. Other Modifications

The hardware configurations of the display apparatus 1 and the components of the display apparatus 1 are not limited to those described in the embodiment. The display apparatus 1 and the components of the display apparatus 1 can have any hardware configuration that implements required functions. For example, although the image processing circuit 13 shown in FIG. 6 is configured to use both the voltage correction method and the brightness correction method, the image processing circuit 13 may use only one of the voltage correction method and the brightness correction method. In the example shown in FIG. 8, the mask pixel processor 1313 is effective only when the number of pixels by which the data pixel and the display pixel are shifted from each other is one or two. Alternatively, the mask pixel processor 1313 can be configured to be effective even when the number of pixels by which the data pixel and the display pixel are shifted from each other is three or more. The liquid crystal panel 17 is not limited to VA panels. Other types of liquid crystal panels such as twisted nematic (TN) panels can be used as the liquid crystal panel 17. The liquid crystal panel 17 can be normally white liquid crystal panels instead of normally black liquid crystal panels.

The number of pixels, the voltage values, the gradation values, the signal levels described in the embodiment are just examples, and the invention is not limited to the examples.

This application claims priority to Japan Patent Application No. 2016-79494 filed Apr. 12, 2016, the entire disclosures of which are hereby incorporated by reference in their entireties.

What is claimed is:

1. An image processing apparatus comprising:

a pixel misalignment processor that:

stores information corresponding to a pixel misalignment between a first image and a second image, the first image being generated from modulating a first color component of light by a first liquid crystal panel of a projector, the second image being generated from modulating a second color component of light, different from the first color component of light, by a second liquid crystal panel of the projector;

determines a cut-off pixel of the first image, disposed at a dummy region of the first image surrounding a display region of the first image, based on the information; and determines a gradation displayed at the cut-off pixel in accordance with a gradation of an edge pixel indicated by an image signal to be inputted to an edge pixel disposed at the display region of the first image and located at a position adjacent to the cut-off pixel.

2. The image processing apparatus according to claim 1, wherein the pixel misalignment processor determines the gradation displayed at the cut-off pixel by multiplying the gradation of the edge pixel by a coefficient k, where k is a positive real number less than 1.

3. The image processing apparatus according to claim 2, wherein the pixel misalignment processor determines the gradation displayed at the cut-off pixel by multiplying the gradation of the edge pixel by a first coefficient k1, where k1 is a positive real number less than 1, and the pixel misalignment processor determines a gradation displayed at a mask pixel located more distant to the edge pixel than the cut-off pixel by multiplying the gradation of the edge pixel by a second coefficient k2, where k2 is a positive real number less than the first coefficient k1.

4. The image processing apparatus according to claim 1, wherein gradation of pixels is represented by a voltage applied thereto, and where Vm denotes a voltage applied to the cut-off pixel and where Vi denotes a voltage applied to the edge pixel, a ratio k=Vm/Vi is given as follows:

$$0.1 \leq k \leq 0.6.$$

5. The image processing apparatus according to claim 1, wherein gradation of pixels is represented by a brightness level thereof, and a ratio of a brightness level of the cut-off pixel to a brightness level of the edge pixel is given as follows:

$$0.05\% \leq (Tm/Ti) \leq 40\%,$$

where Tm denotes the brightness level of the cut-off pixel and where Ti denotes the brightness level of the edge pixel.

6. A display apparatus comprising:

a projector having a first liquid crystal panel that modulates a first color component of light and a second liquid crystal panel that modulates a second color component of light different from the first color component of light, the first liquid crystal panel generating a first image having a display region and a dummy region surrounding the display region of the first image; the second liquid crystal panel generating a second image having a display region and a dummy region surrounding the display region of the second image; and a pixel misalignment processor that stores information corresponding to a pixel misalignment between the first image and the second image, determines a cut-off pixel of the first image, disposed at the dummy region of the first image, based on the information, and determines a gradation displayed at the cut-off pixel in accordance with a gradation indicated by an image signal to be inputted to an edge pixel disposed at the display region of the first image and located at a position adjacent to the cut-off pixel.

7. An image processing method comprising:

storing information corresponding to a pixel misalignment between a first image and a second image, the first image being generated from modulating a first color component of light by a first liquid crystal panel of a projector, the second image being generated from modulating a second color component of light, different from the first color component of light, by a second liquid crystal panel of the projector;

determining a cut-off pixel of the first image, disposed at a dummy region of the first image, based on the information; and determining a gradation displayed at the cut-off pixel in accordance with gradation indicated by an image signal to be inputted to an edge pixel disposed at the display region of the first image and located at a position adjacent to the cut-off pixel.

* * * * *